US005309815A

United States Patent [19]

Möller et al.

[11] Patent Number: 5,309,815

[45] Date of Patent: May 10, 1994

[54] FIREARM, PARTICULARLY HANDGUN

[75] Inventors: Tilo Möller, Oberndorf/Neckar; Rudolf Brandl, Dornhan-Weiden; Helmut Weldle, Oberndorf/Beffendorf, all of Fed. Rep. of Germany

[73] Assignee: Heckler & Koch GmbH, Oberndorf/Neckar, Fed. Rep. of Germany

[21] Appl. No.: 857,028

[22] Filed: Mar. 24, 1992

[30] Foreign Application Priority Data

Mar. 25, 1991 [DE] Fed. Rep. of Germany ..... 4109777

[51] Int. Cl.[5] ..... F41A 25/12

[52] U.S. Cl. ..... 89/163; 89/177; 89/196

[58] Field of Search ..... 89/163, 177, 178, 196

[56] References Cited

U.S. PATENT DOCUMENTS

| | | | |
|---|---|---|---|
| 684,055 | 10/1901 | Gabbett-Fairfax | 89/196 |
| 834,753 | 10/1906 | Reifgraber | 89/177 |
| 954,904 | 4/1910 | White | 89/196 |
| 2,776,602 | 1/1957 | Sturtevant | 89/196 |
| 3,504,594 | 4/1970 | Greeley | 89/163 |
| 4,485,723 | 12/1984 | Sarony | 89/163 |

FOREIGN PATENT DOCUMENTS

| | | | |
|---|---|---|---|
| 2590012 | 5/1987 | France | 89/178 |
| 25234 | 8/1908 | Sweden | 89/163 |

*Primary Examiner*—Stephen C. Bentley
*Attorney, Agent, or Firm*—Egli International

[57] ABSTRACT

Locked automatic pistol in connection with which the recoil-produced delivery of momentum of the barrel (2) is buffered.

19 Claims, 8 Drawing Sheets

FIREARM, PARTICULARLY HANDGUN

BACKGROUND OF THE INVENTION

The present invention relates to a firearm, particularly a handgun with a movably mounted barrel which takes up at least a part of the fire recoil and, after passing over a predetermined first travel path, gives it up, in whole or in part, to a first force receiver.

In the following, terminology will be employed which serves for easier reading of the specification but is not to be understood in a limitative manner. For instance, the expressions "top", "bottom", "front", "rear", "transverse", etc. refer to a device of the above-indicated type which is held in its customary position of use; for instance to a pistol upon ordinary shooting in precision target shooting. This terminology includes the words mentioned above as well as derivations from these words and words of similar meaning. Thus the front part of the device is that part which faces the target of the cartridges and therefore, for instance, the practice target in the case of a firearm. The longitudinal direction of the device coincides with the direction of shooting.

Devices of the aforementioned type, in particular firearms, are known, for instance, as bolt guns or as hand firearms of the Colt-Browning type, particularly for the firing of heavy cartridges ("Waffenjournal", 1979, No. 7, pp. 908–910).

For a clearer understanding of the starting point of the invention, known pistols of the aforementioned type are shown in FIGS. 1 and 2. These weapons are so-called locked automatic pistols.

In the ready-for-firing position, a swingable tube, referred to below as the barrel 2, rests against an impact bottom 4 of a breechblock 6. The rear section 8 of the barrel which is developed as cartridge chamber has on its top locking lugs 10 which engage into corresponding grooves in the breechblock 6 and connect the barrel 2 rigidly to the breechblock 6 before the firing.

Furthermore, such pistols have a handle 12 the handgrip of which (not shown here) generally surrounds a magazine shaft for receiving a replaceable magazine. The breechblock 6 is displaceably mounted on the handle 12. Upon the firing of a shot, the cartridge is accelerated in forward direction. In accordance with the principle of conservation of momentum, there is thereby produced the known recoil which drives the barrel together with the breechblock 6 towards the rear. The breechblock 6 then carries out a return or opening movement in longitudinal direction from the ready-for-firing position towards a housing-attached breech stop 14, against the action of a closure spring 16 which is arranged below and substantially parallel to the barrel 2.

In FIG. 1, the rear section 8 of the barrel bears on its lower side a barrel attachment 18 having a cam curve which consists essentially of an unlocking curve 20 and a locking curve 22.

Upon firing, the barrel 2 and the breechblock 6 move together over the path s. Thereupon, under the simultaneous action of a control bolt 24 which is fixed on the housing and comes into engagement with the unlocking curve 20 (FIG. 1), or by the action of link members 26 (FIG. 2), the barrel comes out of engagement with the breechblock 6. The breechblock 6 then travels further by itself up to a breech stop 14 which is fixed on the housing, reverses, and is again accelerated forward by the breech spring 16 and therefore carries out a forward travel or closing movement.

During this breechblock forward travel, a new cartridge is fed from the magazine to the cartridge chamber of the barrel 2. The barrel 2 is then swung upward via the control elements described and again locked to the breechblock 6. The barrel 2 and the breechblock 6 then slide together forward until the barrel attachment 18 strikes against a transverse pin 28 which is fastened to the housing and the barrel 2, together with the breechblock 6, comes to a stop in the position of readiness for fire.

After the detonating of the cartridge, the process described is repeated.

There are a very large number of structural variants of the Colt-Browning system described above; all variants have, in common, a barrel which, upon its rearward movement together with the breechblock, swings downward at least at its rear section and thereby releases the breechblock.

As is known, the recoil of the known firearms of this type is disturbing and frequently painful. This is particularly true of handguns of large caliber in which the recoil is transmitted from the housing to the firing hand. Upon rapidly successive firing, the recoil become unpleasant for the user and impairs the accuracy of the shooting.

It is already known to reduce the disturbance caused the user by the recoil by having the breechblock, after passing over a travel path, strike a force receiver which is fastened to the housing, not directly but via a buffer device.

Thus, for instance, U.S. Pat. No. 4,031,808 (RAVILLE) describes an automatic pistol of the Colt-Browning type which has a link. The link, in known manner, releases the barrel from its lock to the breechblock as soon as the barrel has traveled in rearward direction over the locking path. The breechblock transmits its recoil to a force receiver fixed to the housing first of all via a breech spring and then, after passing over a travel path, via a pneumatic cylinder/piston arrangement.

Furthermore, Swiss Patent 494 384 (Heckler & Koch) also describes an automatic pistol having a breechblock which, upon its return travel, first comes against the breech spring and, after passing over a travel path, against a buffer device. The breechblock, the barrel and the buffer device are in this case parts of the automatic loading mechanism.

Finally, German DE 87 09 139 U1 (PETERS) also describes an automatic pistol of the Colt system. The barrel of this automatic pistol has a barrel attachment which, by a control surface, slides onto a ramp surface of a control piece which is fixed to the housing and in this way eliminates its prior interlock with the breechblock. The control piece is connected with a guide rod for the breech spring, the guide rod and the breech spring being located below the barrel.

SUMMARY OF THE INVENTION

The object of the invention is further to develop a firearm of the aforementioned type while retaining, as far as possible, its previous advantages, in particular so that the annoyance to the user caused by the recoil is further reduced.

This object is achieved by providing a firearm that has at least one movably mounted barrel which takes up at least part of the firing recoil and, after passage over a first travel path, gives it up, in whole or in part, to a first force receiver. The firearm further having a first device for the buffered transmission of the recoil from the barrel to the first force receiver.

Therefore, after passing over a predetermined first travel path, the barrel, instead of transferring the recoil taken up by it directly and suddenly to a part of the device fastened to the housing, does so gradually and therefore over a longer time and thus clearly reduced in amount. In this way the user, as well as the device itself, are spared.

The buffer device of the invention is preferably inserted in a firearm which has a magazine shaft to receive a plurality of cartridges and a self-loading mechanism which automatically introduces the cartridge into a cartridge barrel after each shot. In this case, the barrel, the first force receiver, and the first buffer means are then part of the self-loading mechanism.

In automatic weapons of this type, it is known per se, and also of advantage here, to provide a movably mounted breechblock which also takes up a part of the fire recoil and transmits it, after passing over a second predetermined travel path, to a second force receiver, either entirely or in part. In this way, the troublesome effect of the recoil is further reduced.

As is customary, for example, in locked automatic firearms, the barrel and the breechblock are preferably detachably locked to each other, then jointly pass over the first travel path and are then unlocked with the cooperation of the first force receiver. Studies carried out by the applicant have shown that a strong transmission of momentum frequently takes place upon the unlocking of the barrel from the breechblock. The buffering of the absorption of the force by the first force receiver therefore specifically reduces this particularly unpleasant "unlocking blow".

There is particularly preferred a second means for the buffered giving off of recoil from the breechblock to the second force receiver, which leads to a further reduction in the amount of the instantaneous transmission of the recoil momentum and is also known per se.

The cost of manufacture of the device is kept relatively low in the manner that the first and the second force receivers are buffered by the same buffer device. The reduction in the number of parts resulting from this also leads to a corresponding reduction in the overall dimensions of the device.

According to a particularly preferred embodiment, the firearm is a locked automatic firearm, particularly a handgun. The first force receiver is developed as barrel stop. The other parts are essentially known from the Colt-Browning system. Differing from the Colt-Browning system, the barrel stop is, however, spring-loaded. Instead of this, or in addition to this, the barrel attachment which runs onto the barrel stop is also buffered. The soft taking up of the unlocking blow obtained hereby leads to particularly gentle operation of the weapon and high fire accuracy.

In a further embodiment of the invention, the second force receiver is also developed as a spring-loaded breech stop. Instead of this or in addition to this, the element of the breechblock which travels against the breech stop is also developed with soft spring action. By these measures, the remaining return energy of the breechblock is transmitted gently to the handle.

Another preferred embodiment of the invention furthermore has a known breech spring which is stated on a spring guide rod arranged below the barrel and substantially parallel to it. Differing from the known Colt-Browning system, however, the spring guide rod is movable longitudinally against the action of a buffer spring developed as buffer device and the rear end of the spring guide rod is developed as barrel stop. This measure has the following advantages, among others: there are multiple possibilities for the application of the buffer spring, which is preferably developed as a compression spring; the structural size of the ordinary Colt-Browning construction is not increased by the additional buffer spring.

It is particularly preferred if the buffer spring is seated within the breech spring on the spring guide rod and has its front end resting against a projection of the spring guide rod and its rear end together with the breech spring resting against the housing or handle. This measure reduces to a minimum the structural changes for obtaining an improved automatic pistol.

In another preferred embodiment, the rear end of the spring guide rod is provided on its lower side with a guide surface, in particular in the form of a recess, which cooperates with a guide element, particularly a transverse bolt, which is fixed on the housing and attached to the handle. In this way, the spring guide rod, while economical to manufacture, is imparted optimal guidance, which is preferably further increased by the fact that it passes through a guide channel in the front end of the breechblock. Additional guidance is preferably obtained in the manner that the rear end of the spring guide rod slides on both sides of the guide recess on a support part which also receives the guide transverse bolt.

In accordance with another preferred embodiment, the buffer spring also serves to buffer the breech stop. For this purpose, the projection against which the front end of the buffer spring rests is developed as a bushing, its end forming the breech stop. In this connection, the bushing is either arranged fixed on the spring guide rod or displaceable over a limited distance in such a manner that it is pressed forward by the buffer spring in position of rest. A rigid attachment of the bushing to the spring guide rod has the advantage that the breechblock, upon the return travel, is not only intercepted via the bushing by the buffer spring, but, in addition, the inert masses of the backward sliding spring guide rod and of the barrel carried along by it exert a decelerating action. On the other hand, if the bushing is displaceable on the spring guide rod, only the buffer spring-aside from the breech spring-and the inert mass of the bushing intercept the breech. For this purpose, the buffer spring must be harder than in the case of the stationary bushing. Finally, the buffer spring is so designed that it again moves the barrel back in forward direction (via the buffer path) after it has traveled onto the barrel stop and passed through the buffer path, before the breechblock has reached the breech stop (bushing).

A stable position of the rest of the transverse bolt and of the spring guide rod is promoted by the fact that the guide transverse pin engages into a depression on the rear end of the guide recess.

Other preferred features of the invention will become evident from the following description of preferred embodiments. These embodiments are shown diagrammatically in the accompanying drawing, which also diagrammatically shows the prior art which has already been described.

DETAILED DESCRIPTION OF THE PREFERRED EMBODIMENTS

Figure 1A:
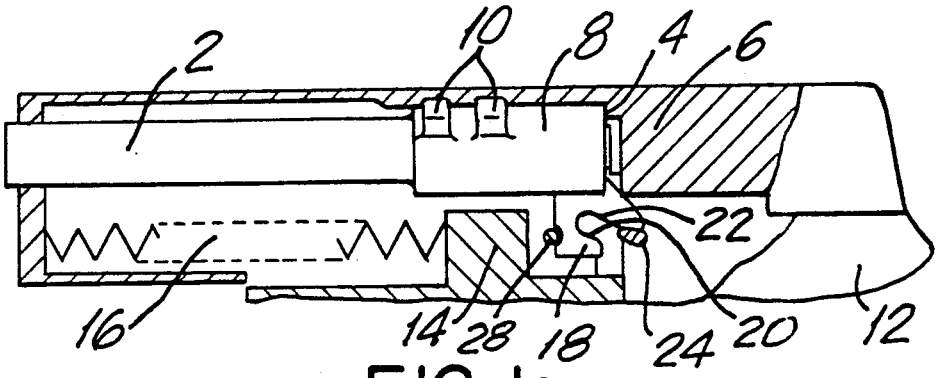
FIGS. 1*a* to 1*c* show a known Colt-Browning system with cam curve and control bolt in different operating conditions.
Figure 1B:
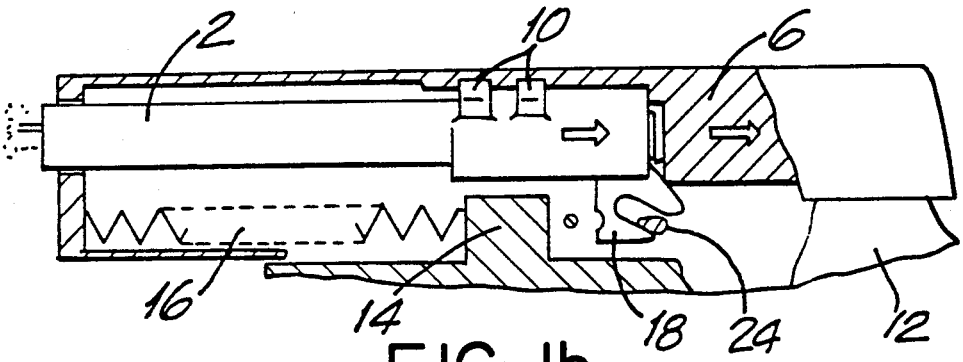
Figure 1C:
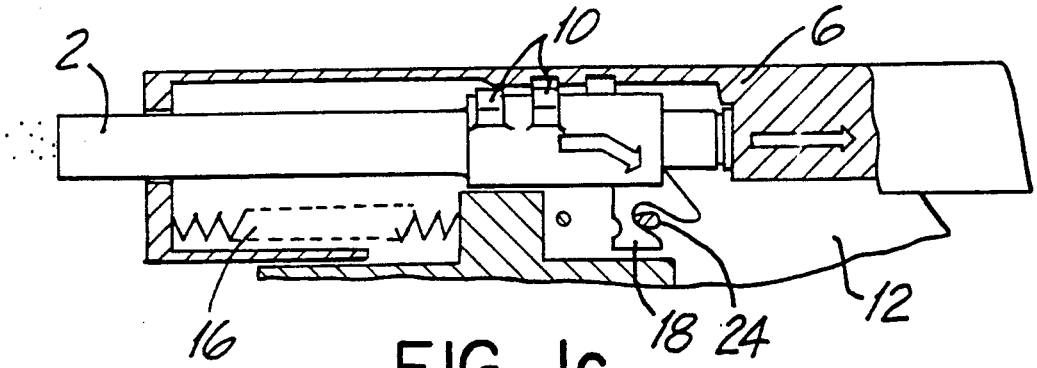
Figure 2A:
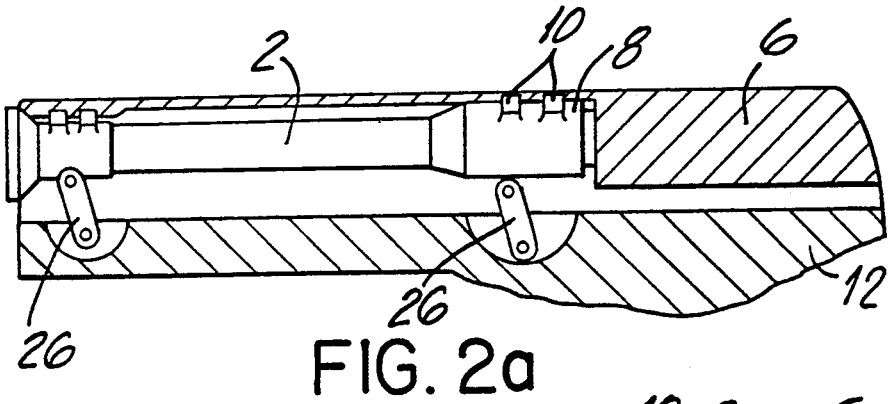
FIGS. 2*a* to 2*c* show a further known system having a barrel chain control in different operating conditions.
Figure 2B:
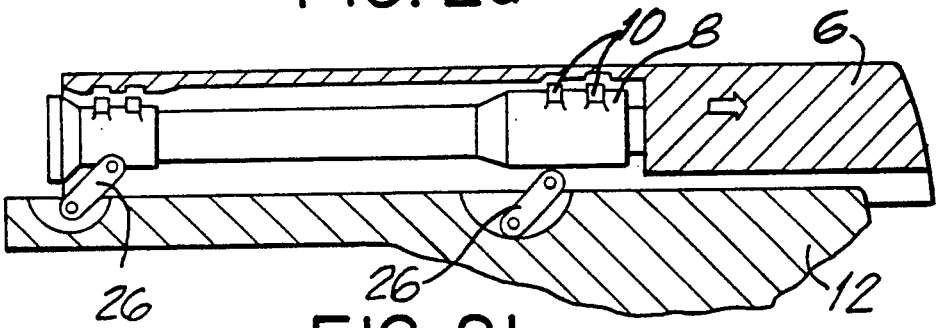
Figure 2C:
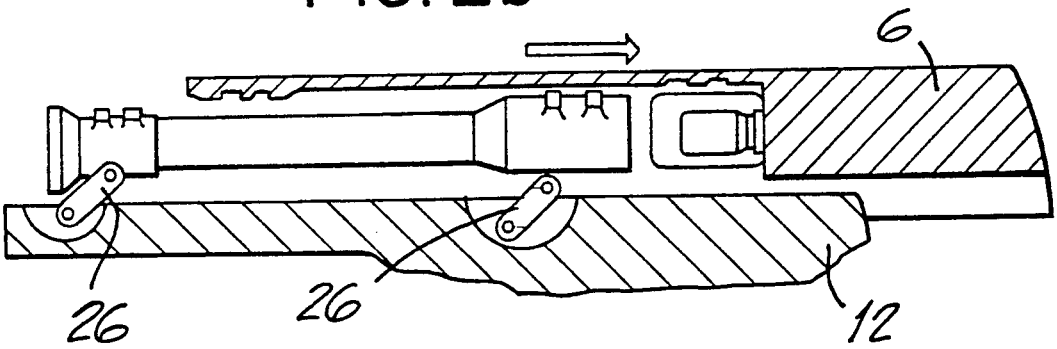

The known locked automatic pistols shown in FIGS. 1 and 2 have already been described above, so that reference may be had to the description given there.

The embodiments shown in FIGS. 3*a* to 3*e* proceed from the Colt-Browning system shown in FIG. 1 and therefore employ certain of the elements of identical or similar function already described. To this extent, in order to avoid repetition, reference is had to FIG. 1. Furthermore, elements of the same or similar function in all the drawings regularly have been given the same reference numbers.

Figure 3A:
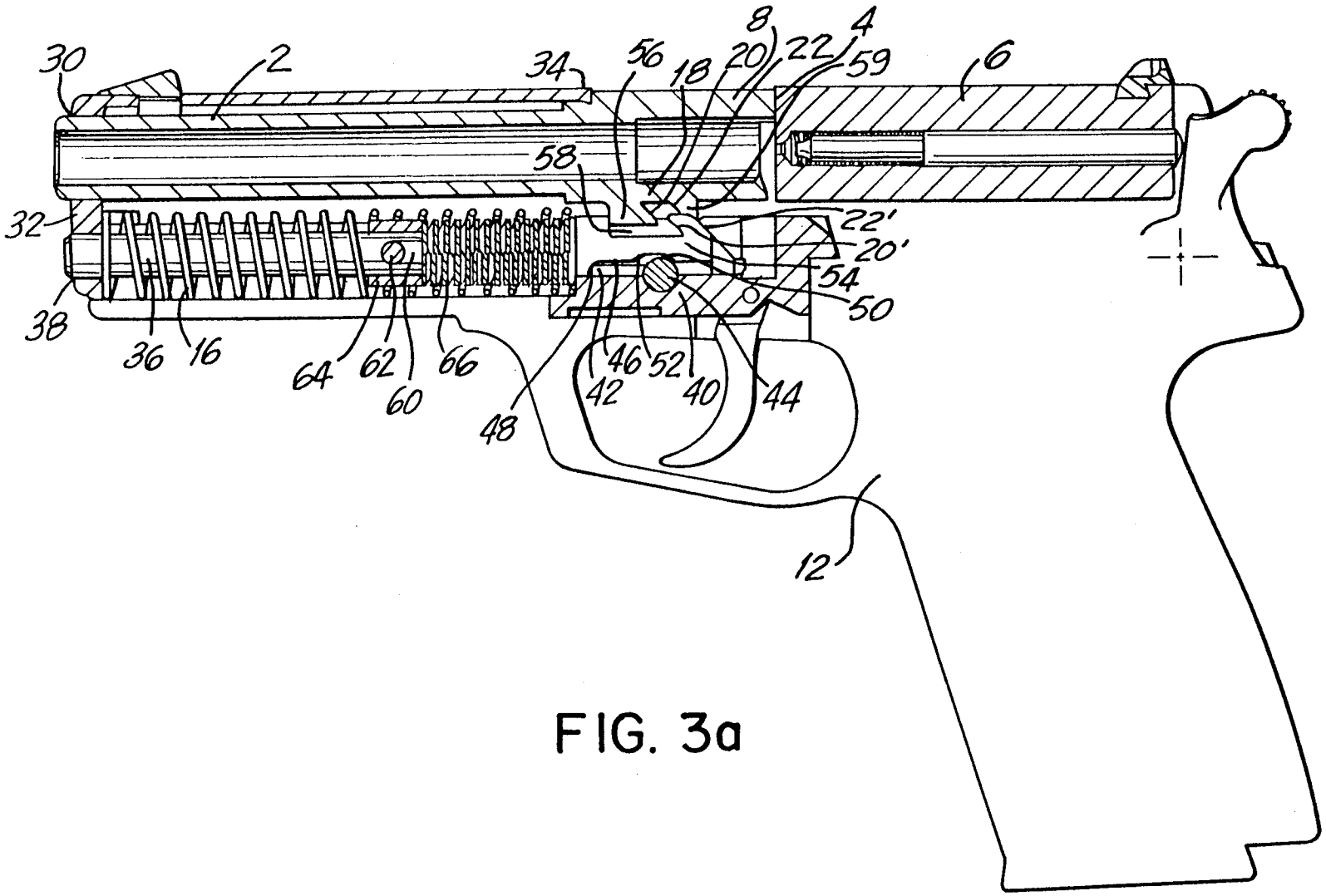
FIG. 3*a* is a vertical section through a first embodiment of the invention, shown in fire-ready position.

The automatic pistol shown in FIG. 3*a* has the Colt-Browning system lock already described and, as main parts, has the handle 12, the movable breechblock 6, and the swingable barrel 2. The barrel 2 is seated in a space hollowed out in the breechblock 6 and on the mouth side passes through a guide bore 30 in the front end 32 of the breechblock 6. The rear section 8 of the barrel, which is developed as cartridge chamber, has its rear end resting against the impact bottom 4 and a shoulder developed on its front end rests against a stop 34 of the breechblock 6.

In the handle 12, below the barrel 2 and parallel to it, a spring guide rod 36 is arranged in longitudinally displaceable manner. Its front end passes through a guide hole 38 in the mouth-side breechblock end 32. The breech spring 16 is seated on the spring guide rod 36 and its front end rests against the front end 32 of the breechblock, while its rear end rests against the mounting part 40, which is fixed on the housing. It is clear that the breech spring 16 strives to move the breechblock 6 into the ready-for-firing position; furthermore, that it is compressed upon the return and opening movements of the breechblock 6.

The rear end of the spring guide rod 36 rests with its lower side against the surface of the support part 40 and can slide back and forth over a limited distance on it. An elongated, substantially trough-shaped recess 42 in the bottom of the rear end of the spring guide rod, together with a transverse bolt 44 fixed in the housing, limits the longitudinal displaceability of the spring guide rod 36 on both sides. The bottom 46 of the recess 42 forms a guide surface which is limited towards the front by the front side wall of the recess 42 and towards the rear by its rear side wall. These side walls are referred to in the following also as front end stop 48 and rear end stop 50. Near the rear end stop 50, the bottom 46 has a shallow depression 52 which is precisely adapted to the periphery of the transverse bolt 44. The depression 52 serves to stabilize the position of the spring guide rod 36 and of the transverse bolt 44 in different operating conditions of the firearm, particularly in the ready-to-fire position.

The rear end of the spring guide rod 36 is provided on its top, and therefore the side facing the barrel 2, with a barrel stop 54 which is provided with a control profile. The barrel attachment 18 facing it is provided with a control profile which is complementary thereto. The two control profiles together lead to cam control in accordance with the Colt-Browning principle. For this, the barrel attachment 18 has an extension 56 in the form of half a dovetail, the rear surface of which forms the unlocking bevel 20. If the barrel 2 and the breechblock 6 are driven towards the rear by the recoil, then the unlocking bevel 20 of the extension 56 slides along an unlocking bevel 20' of the barrel stop 54 which is complementary to it downward into another recess 58 provided in the barrel stop 54. In this way, the barrel 2 is unlocked from the breechblock 6 in known manner. The unlocked position can be noted in FIGS. 3*b* to 3*e*.

The barrel attachment 18 has another extension 59 which is shifted rearward with respect to the extension 56 and which has the locking bevel 22. The locking bevel 22 and the unlocking bevel 20 are substantially parallel to each other and define an obliquely extending groove. The locking bevel 22 of the extension 59 cooperates with a locking bevel 22' on the rear end surface of the barrel stop 54. In unlocked condition (FIGS. 3*b* to 3*e*), the web of the barrel stop 54, which is limited by the unlocking and locking bevels 20' and 22', is seated in the above-mentioned groove (between the unlocking and locking bevels 20 and 22) of the barrel attachment 18.

When the breechblock 6, upon its forward or closing movement, again pushes the barrel 2 into the ready-to-fire position, the two locking bevels 22 and 22' slide over each other, thereby pushing the barrel 2 upward again into its locked position. In this position, the free end surface of the extension 59 rests on the web surface facing it of the barrel stop 54. At the same time, the front end of the extension 56 rests against a corresponding limiting surface of the recess 58.

In accordance with FIGS. 3*a*–3*e*, there is a slot 60 in the spring guide rod 36. A stud bolt 62 is mounted for longitudinal displacement in said slot. The stud bolt 62 passes through a bushing 64 which is displaceably placed over the spring guide rod 36 and is form-locked to it. The bushing 64 is subject to the force of a buffer spring 66 the front end of which rests against the bushing 64. The rear end of the buffer spring 66 rests, in the same way as the breech spring 16, against the mounting part 40 which is fixed on the housing. The buffer spring 66 acts on the bushing 64 in such a manner that the stud bolt 62 comes against the front end of the slot 60. In this way, the spring guide rod 36 is also under initial tension but it is prevented from moving forward by the fact that its rear end stop 50 rests against the transverse bolt 44.

The barrel 2 and the breechblock 6 which is locked to it cannot move forward out of this position under the action of the breech spring 16. The front surface of the barrel extension 56 lies, namely, against the front limiting surface of the spring guide-rod recess 58.

In the embodiment shown, the breech spring 16 surrounds the buffer spring 66 and the bushing 64. In this connection, the front end surface of the bushing 64 serves as breech stop and therefore as stop for the front end 32 of the breechblock.

In principle, the buffer spring could also be arranged between the handle 12 and the rear free end of the spring guide rod 36 and a breech stop could be seated on the spring guide rod 36, approximately at the level of the bushing 64.

The manner of operation of the locked automatic pistol shown will now be described with reference to FIGS. 3*a* to 3*e*. For reasons of greater clarity, only those reference numbers directly referred to are entered in FIGS. 3*b* to 3*e*.

FIG. 3*a* shows the piston in its locked, ready-to-fire position. The unlocking bevel 20 on the barrel attachment 18 is in this connection displaced forward by the locking distance with respect to the unlocking bevel 20' on the barrel stop 54 and therefore by the distance over which the barrel 2 and the breechblock 6 move together upon the unlocking.

Figure 3B:
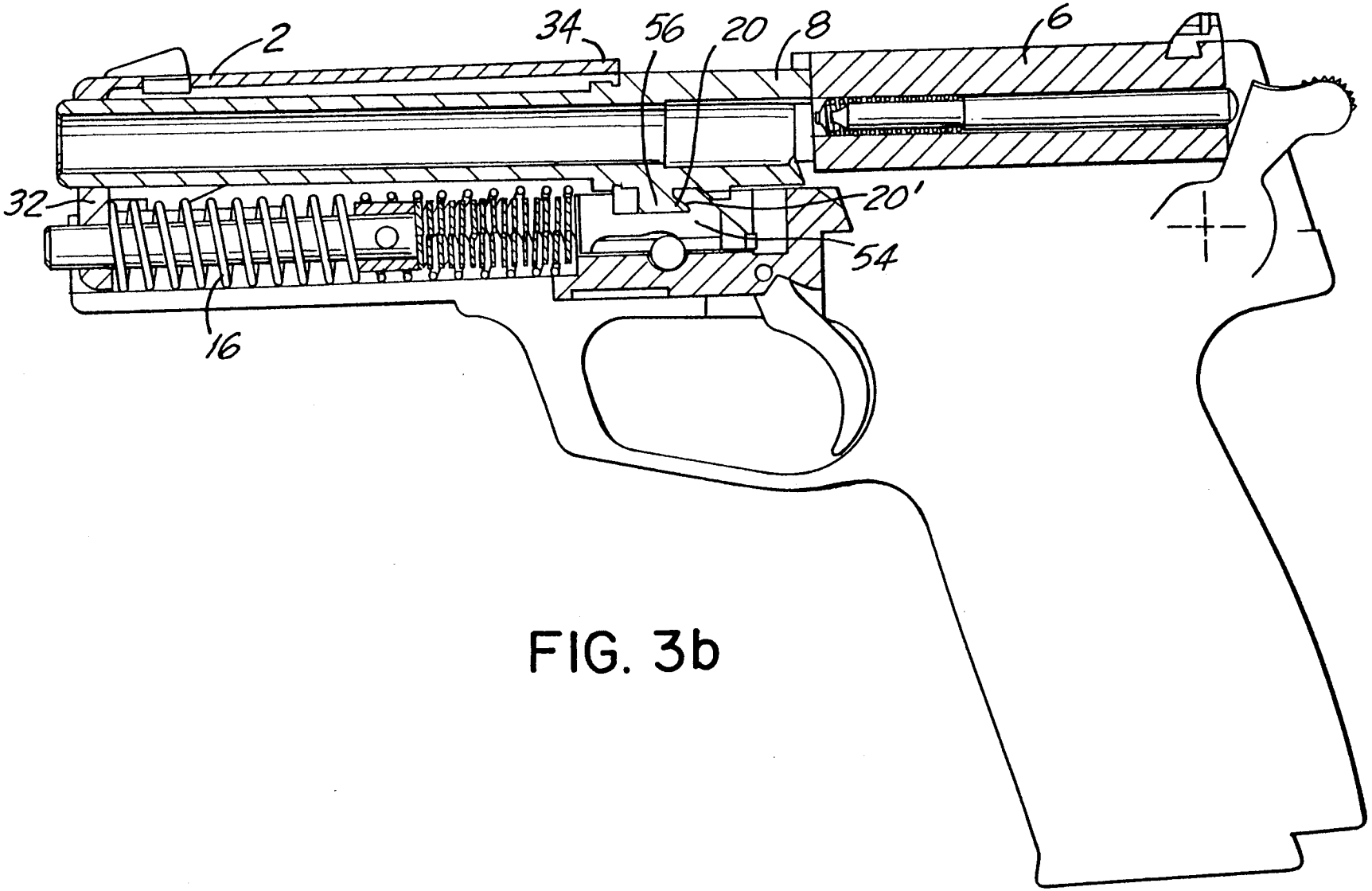
FIGS. 3*b* to 3*e* show further operating conditions of the embodiment of FIG. 3*a;*

If firing is now effected, then the barrel 2 and the breechblock 6 move together towards the rear until the two unlocking bevels 20 and 20' are in engagement with each other, the unlocking bevel 20 thereupon sliding downward on the unlocking bevel 20' and the extension 56 finally resting fully in the barrel stop 54. The tilting movement which the barrel 2 has carried out in this phase is sufficient to loosen the engagement at the surface 34 between the rear barrel section 8 and the breechblock 6 (FIG. 3*b*).

Figure 3C:
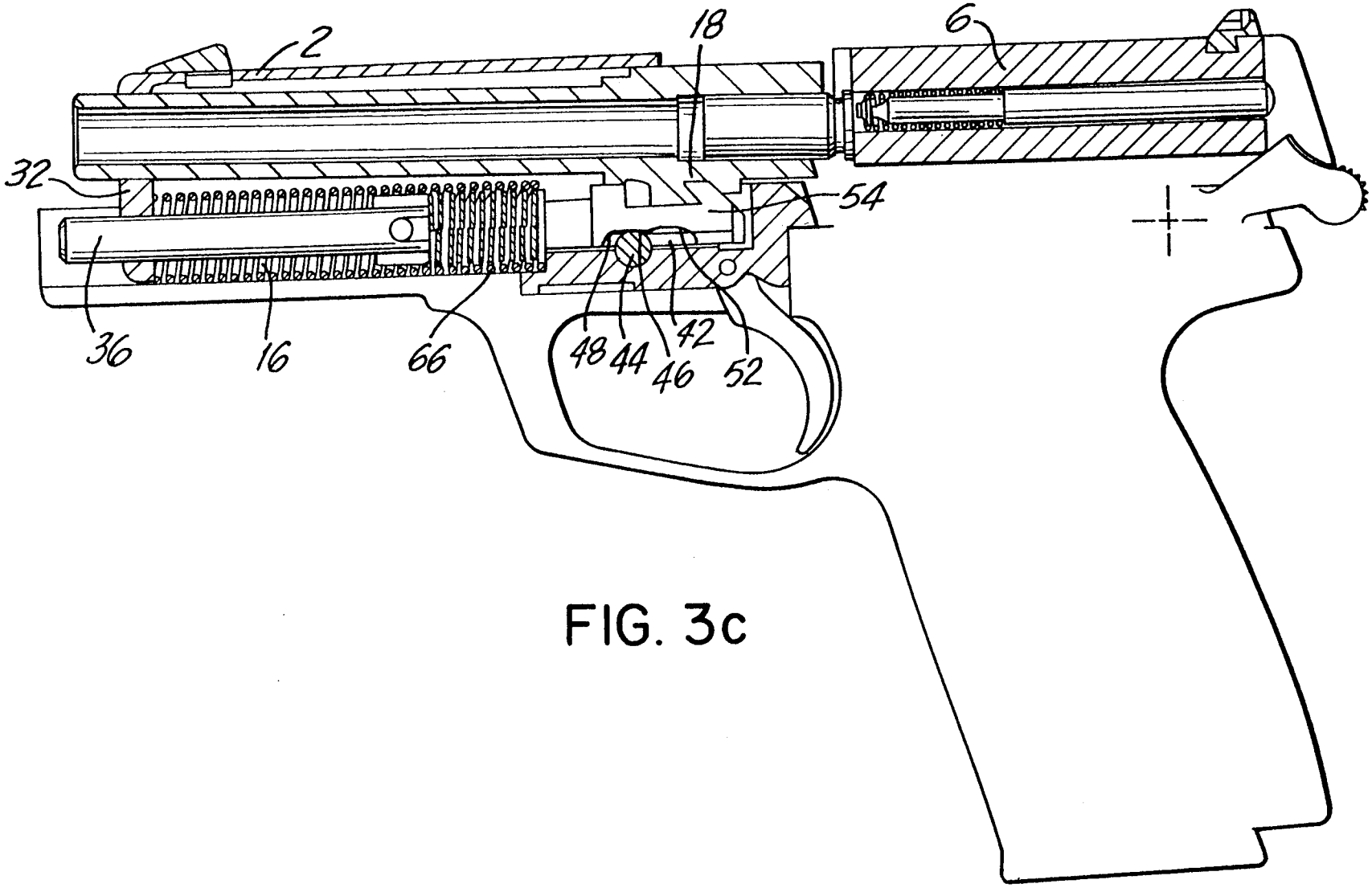
Figure 3D:
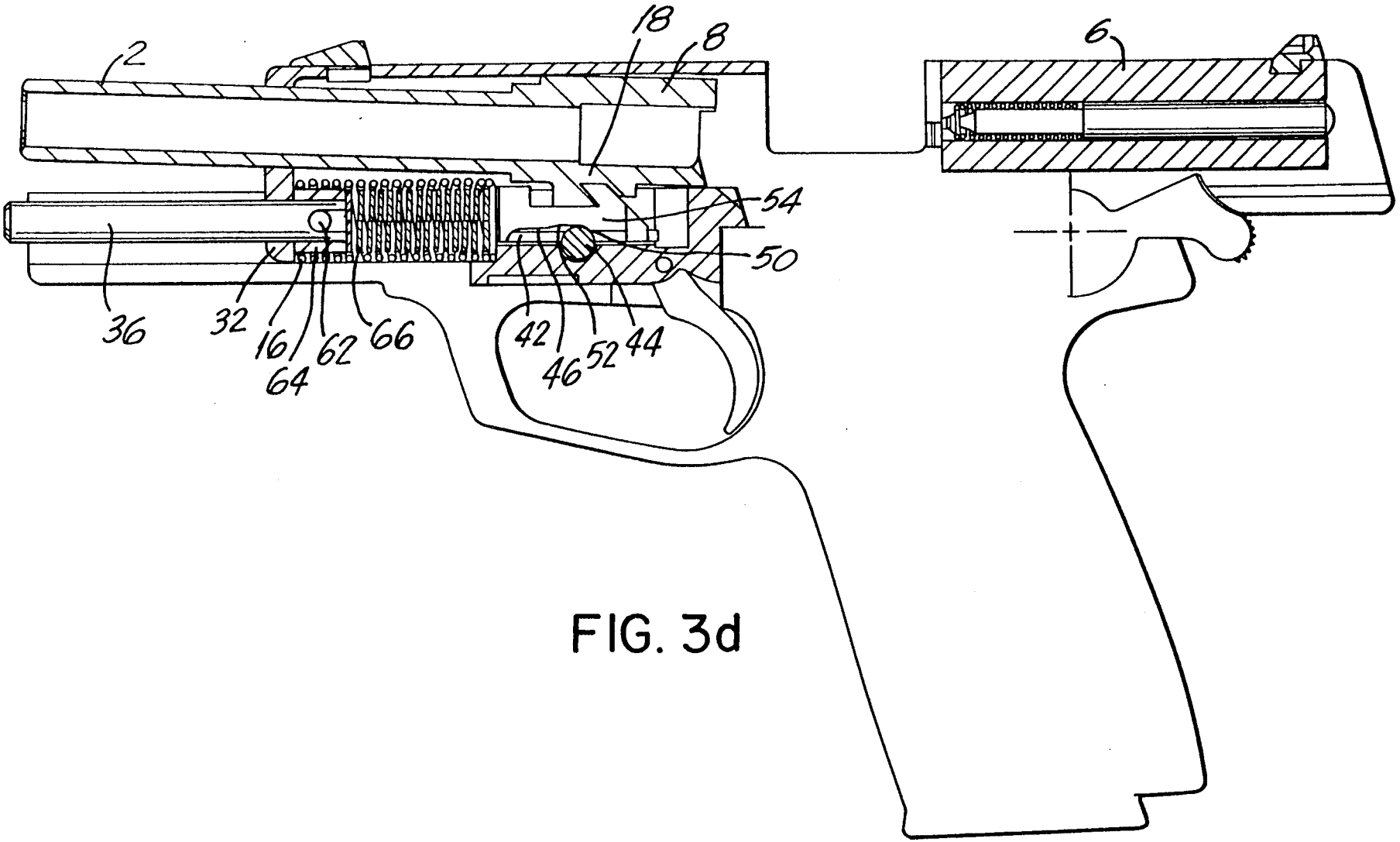
Figure 3E:
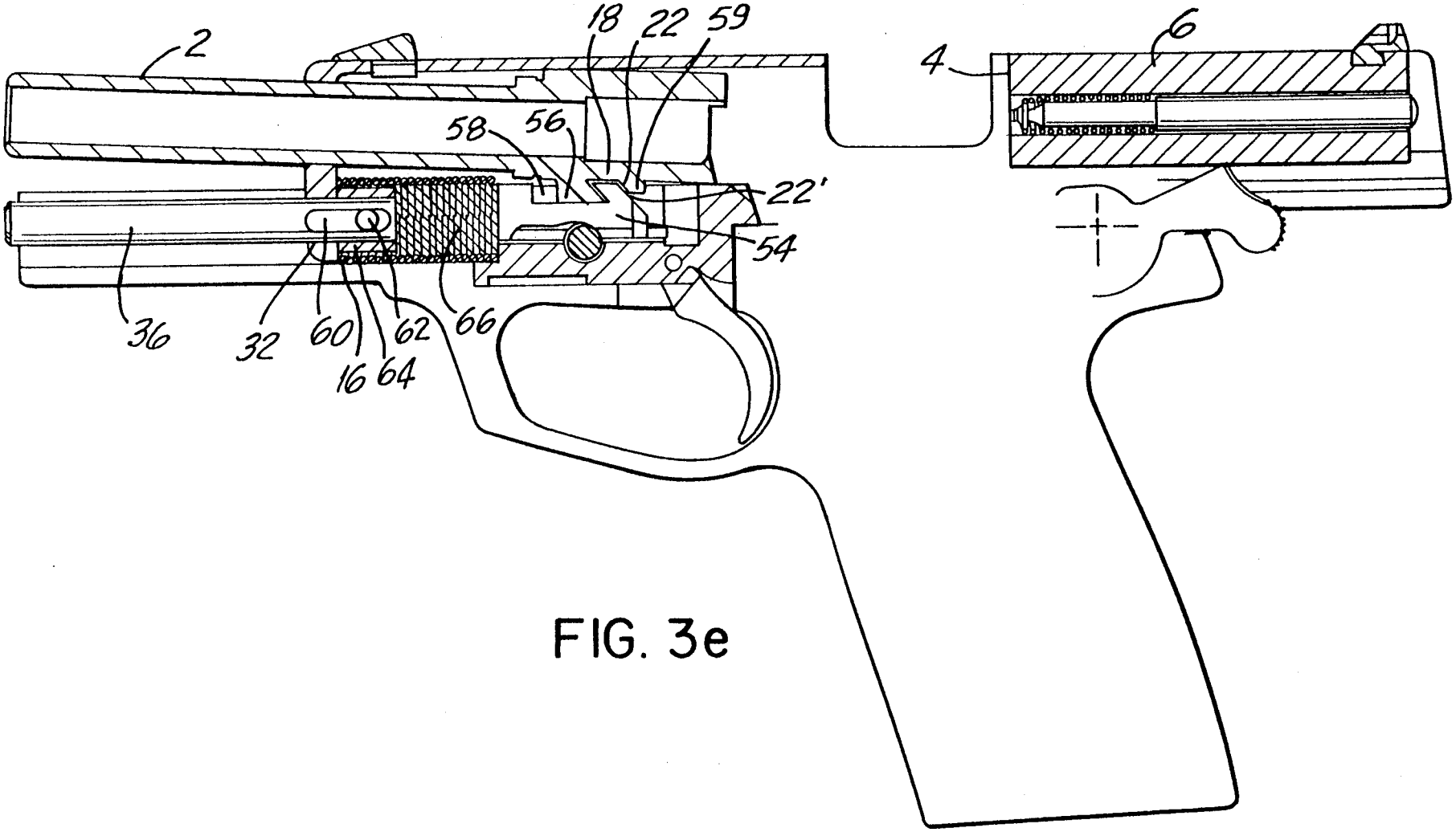

The breechblock 6 can now move further rearward independently of the barrel 2 and therefore continue its opening movement, its front end 32 resting on the breech spring 16 (FIG. 3*e*).

While the breechblock 6 moves rearward, the barrel 2, which is also still in movement and in the meantime has become hooked to the spring guide rod 36, carries the spring guide rod 36 along with it towards the rear against the action of the buffer spring 66. In this connection, the stabilizing engagement between the transverse bolt 44 and the depression 52 is loosened. The shallow bottom 46 of the elongated recess 42 passes onto the transverse bolt 44 and slides rearward over it. The buffer spring 66 is thereby further compressed.

In this phase, the buffered barrel stop 54 softly takes up the barrel attachment 18. This soft take-up phase lasts at most until the front end stop 48 of the recess 42 travels against the transverse bolt 44. The spring guide rod 36 is then moved rearward against the force of the buffer spring 66 by at most the amount of the elongated recess 42. At the same time, the buffer spring 66 is correspondingly compressed. The spring guide rod 36 and the barrel 2 which is hooked to it have come to a stop. The breechblock 6, however, continues its rearward movement.

The buffer spring 66 now presses the spring guide rod 36 (via the bushing 64 and the transversely extending stud bolt 62 which is connected in force-locked manner to it) again towards the front (FIG. 3*d*). The bottom 46 of the elongated recess 42 now slides in forward direction over the transverse bolt 44 until the rear end stop 50 and the depression 52 rest against the transverse bolt 44. The barrel stop 54 of the spring guide rod 36 which is hooked to the barrel attachment 18 in this connection again moves the barrel 2 forward.

The breechblock 6, on the other hand, continues its rearward travel, i.e. its opening movement. In this connection, the upper side of the rear section 8 of the barrel slides along the upper inner wall of the breechblock 6.

As can be noted from a comparison of FIGS. 3*c* to 3*e*, the engagement between the top side of the barrel and the upper breech inner wall has the result that the angle of tilt between the axis of the bore of the barrel 2 and the longitudinal axis of the breechblock 6 increases the further the breechblock 6 moves back in the direction towards its rear end position.

From FIG. 3*d* it can furthermore be seen that, upon the far rearward position of the breechblock 6, the barrel 2 is so tilted that the barrel attachment 18 rests against the rear end of the spring guide rod 36, and the transverse bolt 44 and the depression 52 dependably come into their mutual stabilizing engagement.

In this position, the front end 32 of the breechblock 6 comes against the front end surface of the breech stop, i.e. the bushing 64. The bushing 64 is, in this connection, in its lowest position (FIG. 3*d*), which is established by the engagement of the stud bolt 62 in the slot 60, i.e. the stud bolt 62 lies against the front end of the slot 60.

The buffer spring 66 now acts again as damping spring, in this case together with the breech spring 16: the front end 32 of the breechblock presses the bushing 64 backward against the force of the buffer spring 66 at most as far towards the rear as is possible as a result of the engagement between stud bolt 62 and slot 60 (FIG. 3*e*). The spring guide rod 36 remains in this connection in the position thereof which is fixed by the stabilizing engagement and hooked to the barrel 3. In actual practice, the above-mentioned maximum distance is preferably not moved over completely, but the residual momentum of the breechblock 6 is taken up softly from beginning to end and therefore solely by the buffer spring 64 and the inert mass of the bushing 64 and, of course, also by the breech spring 16.

After the completion of this soft buffering process, the breechblock 6 again strives to move back into its front starting position, driven by the breech spring 16; initially, in addition, also still by the buffer spring 66. The breechblock 6, upon its closing movement, now takes the uppermost cartridge out of the magazine (neither of the two are shown in the figures) and introduces it into the cartridge chamber in the rear section 8 of the barrel.

As soon as the impact bottom 4 has again reached the barrel 2, it pushes it by the engagement distance over the locking bevels 22 (on the extension 59 of the barrel attachment 18) and 22' (on the barrel stop 54) upward and forward until the front end surface of the extension 56 strikes against the front limiting wall of the upper recess 58 (in the rear section of the spring guide rod 36). The free end of the extension 59 of pyramidal frustum shape which faces the barrel stop 54 is, in this position, seated snugly on the free surface section facing it of the barrel stop 54. Assurance is thus had that the barrel 2 always assumes the same position relative to the sighting device seated on the breechblock 6. The ready-to-fire position is again produced (FIG. 3*a*).

The buffer spring 66 is a joint buffer device for the barrel stop 54 and the breech stop, i.e. the bushing 64. The embodiment of FIGS. 3*a* to 3*e* is in this connection so designed that the buffer spring 66 first of all gently intercepts the barrel 2 along the buffer path and then moves it again forward over the buffer path and thereupon also softly intercepts the breechblock 6 and finally also moves the latter again a distance forward. Specifically in this way, the device of the invention differs from the traditional locked automatic pistols. Furthermore, the return movement of the breechblock 6 can be lengthened, as compared with the known pistols, by the length of the slot 60. However, it may also be advantageous for the breechblock 6 (at its front end 32) to strike already against the bushing 64 when the return path necessary for the reloading process has not yet been moved over entirely. Furthermore, it should be borne in mind that the gentle braking of the breechblock 6 at the end of the return movement takes more time than the reversal of the movement of the breechblock of a traditional automatic pistol in which the breechblock strikes against an end stop which is fixed on the housing. That section of the return movement which was necessary up to now in order to provide sufficient time for the advancing of the cartridges in the magazine can thus be done away with, at least in part, in the automatic pistol of the invention.

The automatic pistol described can be changed in detail without going beyond the scope of the invention. Thus the guide surfaces and stop surfaces need not necessarily be developed on the bottom of the barrel. They could also be grooves or ribs on both sides of the barrel. Similarly, the functions of the recess 42, of the bottom 46 serving as guide surface, of the transverse bolt 44, and of the depression 52 can be performed by control cams which may be developed on both sides of the barrel on the latter, on the handle and/or on the breechblock.

Figure 4:
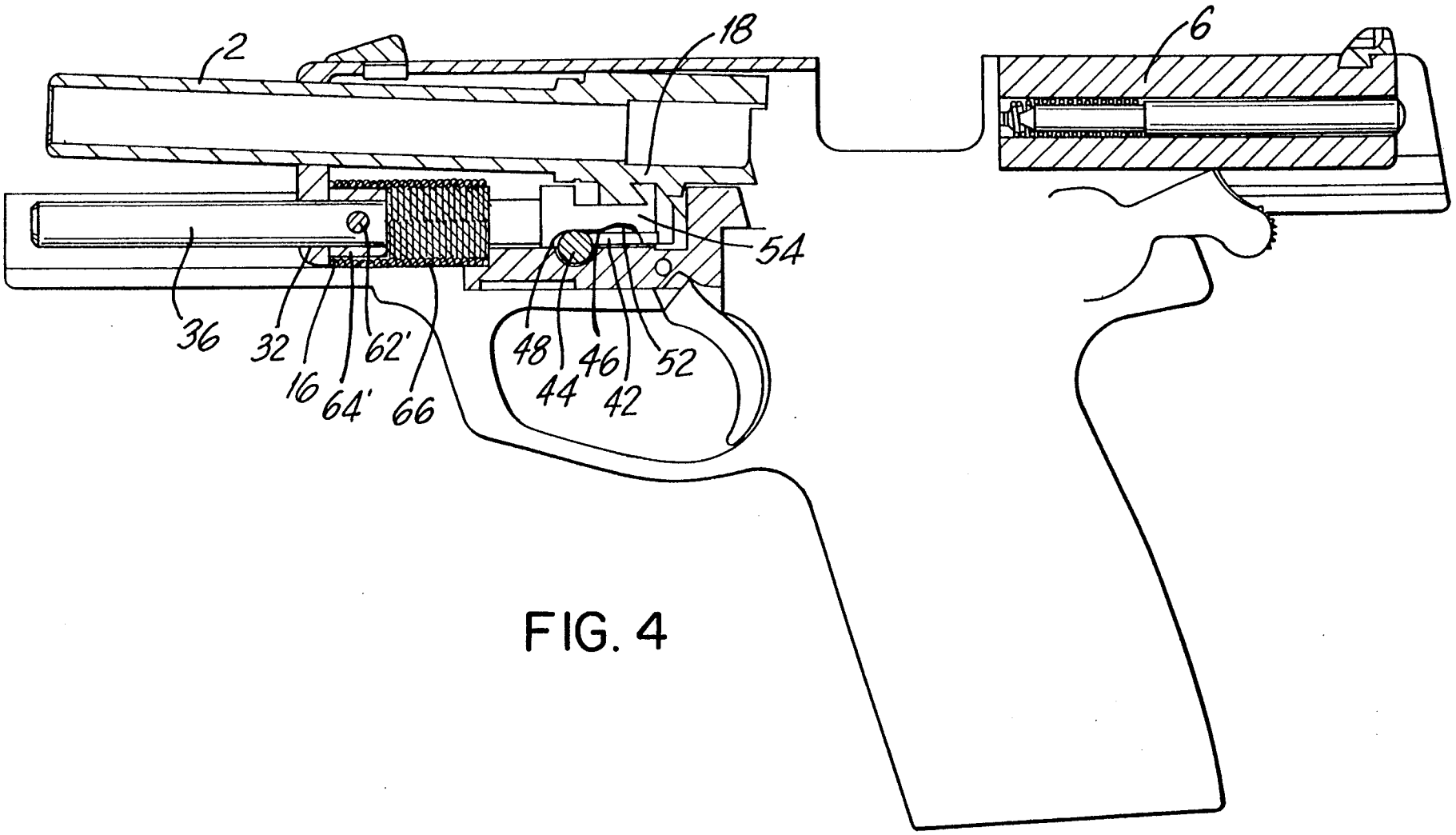
FIG. 4 shows another embodiment in an operating condition corresponding to FIG. 3*e*.

According to FIG. 4, the embodiment of FIG. 3 can be modified in the manner that the bushing 64' is firmly attached to the spring guide rod 36, and the slot 60 of the previous embodiment is therefore eliminated. The embodiment of FIG. 4 is shown only in one operating condition, namely in the position in which it differs from the embodiment of FIG. 3. This condition corresponds to the operating condition shown in FIG. 3*e*.

Differing from the embodiment of FIG. 3*e*, the front breechblock end 32, upon its rearward path, not only carries the bushing 64' along with it, but via the stud bolt 62, it also carries the spring guide rod 36 with it towards the rear. In this connection, the stabilizing engagement between the transverse pin 44 and the depression 52 is again opened. The shallow bottom 46 of the elongated recess 42 comes onto the transverse bolt 44 and slides to the rear over it. This second interception phase lasts at most until the front end stop 48 of the recess 42 strikes against the transverse bolt 44-similar to the case of FIG. 3*c*. Preferably, however, the end stop 42 does not come against the transverse bolt 44.

The barrel stop 54, which is hooked in this phase to the barrel attachment 18, carries the barrel 2 along with it upon its rearward movement.

The remaining momentum of the breechblock 6 is therefore gently taken up by the breech spring 16, the buffer spring 66 and the inert masses of the bushings 64', the spring guide rod 36 and the barrel 2.

The inclusion of the inert masses of the barrel 2 and of the spring guide rod 36 in the taking up of the remaining momentum permits a softer design of the buffer spring 66.

After the completion of this second soft buffer process, the breechblock 6 strives to again return to its front starting position-in the same way as in the embodiment of FIG. 3*a*.

Tests carried out with the embodiment in accordance with FIG. 4 have shown a subjectively very pleasing recoil.

We claim:

1. A firearm comprising:

a housing including a magazine shaft to receive a plurality of cartridges;

a frame;

a barrel;

a breechblock slidable along a travel path with respect to said frame and barrel;

first force receiving means for locking said barrel with said breechblock for a first position of the travel path and for unlocking the breechblock from the barrel after reaching an end of the first position of the travel path so that the breechblock can continue movement along a remainder of the travel path on its own;

second force receiving means with said breechblock being mounted so as to be movable over a second predetermined path so as to take up a part of the fire recoil and transmit it, after passage over the second predetermined travel path, to the second force receiving means;

first buffering means provided between the frame and the barrel for buffering movement of the unlocked barrel so as to avoid unbuffered impact of the barrel onto the frame;

automatic loading means for automatically introducing a cartridge into the barrel after each shot, said automatic loading means including said barrel, said first force receiving means and said first buffering means, with the breechblock being provided so as to, upon firing, carrying out a return, opening movement past the magazine shaft up to a rear point of reversal and then an opposite forward, closing movement into a "ready-to-fire" position, the barrel, when locked to the breechblock in the ready-to-fire position, moves together with the breechblock through an initial phase of the opening movement, travels, after passing over the first portion of the travel path, onto the first force receiving means and is unlocked thereby, releases the breechblock for loading and, finally, after loading, returns together with the breechblock to the ready-to-fire position, and the first force receiving means including a spring-loaded barrel stop, the barrel having an attachment part that engages the barrel stop.

2. The firearm according to claim 1, and further comprising second means for buffering transmission of recoil from the breechblock to the second force receiving means.

3. The firearm according to claim 1, wherein the first and second force receiving means are buffered by the first buffering means.

4. The firearm according to claim 1, wherein the second force receiving means includes a breech stop, at least one of the breech stop and a part of the breechblock traveling onto the breech stop being under spring action.

5. The firearm according to claim 1, and further comprising an additional breech spring arranged so that the breechblock carries out the return, opening movement against the action of the breech spring and the forward, closing movement under the action of the breech spring.

6. The firearm according to claim 5, wherein the barrel is mounted swingably in a closure part so that a front section of the barrel is supported by the breechblock, and so that a rear section of the barrel is lowered upon running onto the barrel stop the barrel attachment part and the barrel stop having elements of a cam control which are complementary to each other and act so as to move the barrel out of its locked engagement with the breechblock and subsequently back into it.

7. The firearm according to claim 6, wherein the breech spring is a coil spring that is seated on a guide rod which is arranged under the barrel substantially parallel to the barrel, the breech spring having a front end that rests on a front side of the breechblock (6) and a rear end that rests on the frame, the barrel stop being provided on a rear end of the spring guide rod, and the spring guide rod being longitudinally movable against the action of a buffer spring.

8. The firearm according to claim 7, wherein the buffer spring is seated within the breech spring on the spring guide rod, rests at its front end on a projection of the spring guide rod (36) and with its rear end, together with the breech spring, on the frame.

9. The firearm according to claim 7, wherein the rear end of the spring guide rod is provided has a lower side facing away from the barrel that is provided with a guide surface which cooperates with a guide element secured to the frame.

10. The firearm according to claim 9, wherein the guide surface is a recess.

11. The firearm according to claim 10, wherein the guide element is a transverse bolt.

12. The firearm according to claim 11, wherein the transverse bolt rests in a support part which is fixed to the frame, the buffer spring and the breech spring rest on a front end of the support part, and sections of the spring guide rod located on both sides of the guide recess slide on a surface of the support part which faces them.

13. The firearm according to claim 7, wherein the buffer spring is arranged so that after the barrel has moved over the buffer path, the buffer spring moves the barrel forward over the buffer path before the breechblock has reached the breech stop.

14. The firearm according to claim 8, wherein the projection is a bushing that has a front end that forms the breech stop.

15. The firearm according to claim 14, wherein the bushing is arranged to be displaceable over a limited distance on the spring guide rod so that in a rest position the bushing is pressed forward by the buffer spring.

16. The firearm according to claim 14, wherein the bushing is firmly connected to the spring guide rod.

17. The firearm according to claim 11, wherein the guide recess [(42) is provided at its rear end with a depression into which the guide transverse bolt is engageable in a rest position.

18. A firearm according to claim 1, wherein said firearm is a handgun.

19. A firearm according to claim 1, wherein said barrel attachment part is spring-loaded.

* * * * *

UNITED STATES PATENT AND TRADEMARK OFFICE

CERTIFICATE OF CORRECTION

PATENT NO. : 5,309,815

DATED : May 10, 1994

INVENTOR(S) : Moller et al

It is certified that error appears in the above-indentified patent and that said Letters Patent is hereby corrected as shown below:

On the title page, item [75] add the fourth inventor Hubert Krieger.

Signed and Sealed this

Twenty-eight Day of February, 1995

*Attest:*

Bruce Lehman

BRUCE LEHMAN

*Attesting Officer*

*Commissioner of Patents and Trademarks*